US005982091A

United States Patent [19]

Konishi

[11] Patent Number: 5,982,091

[45] Date of Patent: Nov. 9, 1999

[54] FLAT DISPLAY APPARATUS

[75] Inventor: Morikazu Konishi, Kanagawa, Japan

[73] Assignee: Sony Corporation, Japan

[21] Appl. No.: 08/574,859

[22] Filed: Dec. 19, 1995

[30] Foreign Application Priority Data

Dec. 28, 1994 [JP] Japan ..... 6-328630

[51] Int. Cl.[6] ..... H01J 1/02

[52] U.S. Cl. ..... 313/495; 313/309; 313/310; 313/351

[58] Field of Search ..... 313/309, 336, 313/351, 310, 495, 496, 497

[56] References Cited

U.S. PATENT DOCUMENTS

| | | | |
|---|---|---|---|
| 4,904,895 | 2/1990 | Tsukamoto et al. | 313/351 |
| 5,148,079 | 9/1992 | Kado et al. | 313/309 |
| 5,173,635 | 12/1992 | Kane | 313/309 |
| 5,256,936 | 10/1993 | Itoh et al. | 313/309 |

*Primary Examiner*—Ashok Patel
*Attorney, Agent, or Firm*—Ronald P. Kananen; Rader, Fishman & Grauer

[57] ABSTRACT

A flat display apparatus provided with emitter electrodes for emitting electrons and gate electrodes for controlling the electrons emitted from the emitter electrodes, the emitter electrodes and the gate electrodes being formed on the same plane at positions facing a fluorescent screen.

20 Claims, 4 Drawing Sheets

FLAT DISPLAY APPARATUS

BACKGROUND OF THE INVENTION

1. Field of the Invention

The present invention relates to a flat display apparatus having an array of field emission cathodes (emitter electrodes).

2. Description of the Related Art

A flat display apparatus having an array of electric-field emission cathodes is known as the related art.

The flat display apparatus is comprised of a silicon substrate on which are successively deposited a silicon oxide or other insulating film and gate electrodes. In the array of cavities between the gate electrodes and the insulating film, an array of microcathodes with tapered front ends is arranged.

A counter plate on which a fluorescent screen is formed is disposed at a predetermined distance from the substrate on which the microcathodes are formed. The flat display is realized by the emission of electrons to the fluorescent screen from the front ends of the microcathodes scanned by the gate electrodes.

In the flat display apparatus of this related art, it is important that the radii of curvature of the front ends of the microcathodes be kept uniform. If there is any variation in the radii of curvature, the front ends of some of the microcathodes will be destroyed by the emission, electrons will not be emitted, and therefore there will be pixel defects.

A technique has been developed for ensuring a uniform radii of curvature for the front ends of microcathodes.

In a flat display apparatus having microcathodes of this construction however, since it is basically necessary to fabricate an array of microcathodes with tapered front ends, the process of forming of the microcathodes becomes complicated. Accordingly, the achievement of a uniform radius of curvature for the front end of each of the microcathodes and uniform arrangement at relative positions with respect to the gate electrodes (extraction voltage) remains difficult, variations occur in the extraction voltage, and the problem of a shortened useful life due to the destruction of the front ends of the microcathodes remains.

SUMMARY OF THE INVENTION

A first object of the present invention is to provide a flat display apparatus whose emitter electrodes and gate electrodes can be fabricated by a simple production process and where the relative positional relationship between the emitter electrodes and gate electrodes is uniform.

A second object of the present invention is to provide a construction of a flat display apparatus which does not require the formation of emitters with tapered front ends.

According to one aspect of the present invention, there is provided a flat display apparatus provided, with an electron emitter for emitting electrons and a gate electrode for controlling the electrons emitted from the emitters, the electron emitter and gate electrode being formed on the same plane at positions facing a fluorescent screen.

According to another aspect of the invention, there is provided a flat display apparatus provided with an emitter electrode for emitting electrons, a gate electrode for controlling the emission of electrons from the emitter electrodes, a drive substrate on which the emitter electrode and gate electrode are formed, and a fluorescent screen which is positioned a predetermined distance away from and in a substantially parallel direction to th emitter electrode and gate electrode.

According to still another aspect of the invention, there is provided a flat display apparatus provided with an emitter electrode for emitting electrons, a gate electrode for controlling the emission of electrons from the emitter electrode, a drive substrate on which the emitter electrode and gate electrode are formed, and a counter substrate having a fluorescent screen which is positioned a predetermined distance away from and substantially parallel to the drive substrate, wherein the emitter electrode and the gate electrode are formed on the same plane and are arranged on the surface of the drive substrate a predetermined distance away from and in a substantially parallel direction to the fluorescent screen.

Preferably, the width of the front ends of the emitter electrode at the gate electrode side is substantially equal to the width of the substrate.

Preferably, the distance between the emitter electrode and gate electrode and the thickness of the emitter electrode are determined so that the electric-field intensity between the emitter electrode and gate electrode becomes at least 0.1 V/Å.

Preferably, the thickness of the emitter electrode is not more than 100 Å.

Preferably, trenches are formed in the surface of the drive substrate at positions between the emitter electrode and gate electrode.

Preferably, the emitter electrode or each of the gate electrodes is comprised of a root electrode and a plurality of branch electrode branching from the two sides of the root electrode.

Preferably, the emitter electrodes are formed by molybdenum or molybdenum silicide or tungsten silicide and the width of the electrode at the gate electrode side is substantially equal to the width of the substrate.

That is, in the flat display apparatus according to the present invention, the emitter electrode and gate electrode are arranged on the surface of a drive substrate at a predetermined distance from and in a substantially parallel direction to a fluorescent screen and the thickness of the emitter electrode is set to enable the emission of electrons from the emitter electrode. By applying a negative voltage to the emitter electrode, applying a positive voltage, including 0V, to the gate electrode, and applying a positive voltage to the anode electrode of the fluorescent screen, a strong electric-field is created at the front ends of the emitter branch electrodes of the emitter electrode. As a result, electrons are emitted from the front ends of the emitter branch electrodes toward the gate electrode. While heading toward the gate electrode, the paths of progression of the electrons are bent to turn toward the higher potential anode electrode side so the electrons strike the fluorescent screen which then gives out light.

In the flat display apparatus of the present invention, by forming the emitter electrode and the gate electrode in the same layer, it is possible to simplify the production process compared with the production process of a flat display apparatus having microcathodes (emitter electrodes) with tapered front ends as in the conventional structure.

By forming the emitter electrodes so that they become uniform in thickness, it is possible to suppress fluctuations in the extraction voltage from the emitter electrodes. That is, by controlling the thickness of the emitter electrode to the thickness necessary for field emission (not more than several hundred angstroms) and suppressing the variation in thickness to within a predetermined range (±5%), it is possible to realize uniformity of the extraction voltage and a longer lifetime of the emitter electrode.

Further, it is possible to adjust the extraction voltage of the emitter electrode by controlling the thickness of the emitter electrode. By adjusting the voltage by controlling the thickness of the emitter electrode, it is possible to set the extraction voltage lower assuming the same field intensity as in the past.

Further, by making the width of the front ends of the emitter electrode on the gate electrode side substantially equal to the width of the root ends, the path of the electrons emitted from the emitter electrode and heading toward the gate electrode becomes constant and there is less fear of pixel defects.

BRIEF DESCRIPTION OF THE DRAWINGS

The above objects and features of the present invention will be more apparent from the following description of the preferred embodiments made with reference to the accompanying drawings, wherein:

FIGS. 1A and 2A are explanatory views of cross-sections of key portions of a flat display apparatus according to a first embodiment of the present invention;

DESCRIPTION OF THE PREFERRED EMBODIMENTS

Figure 1A:
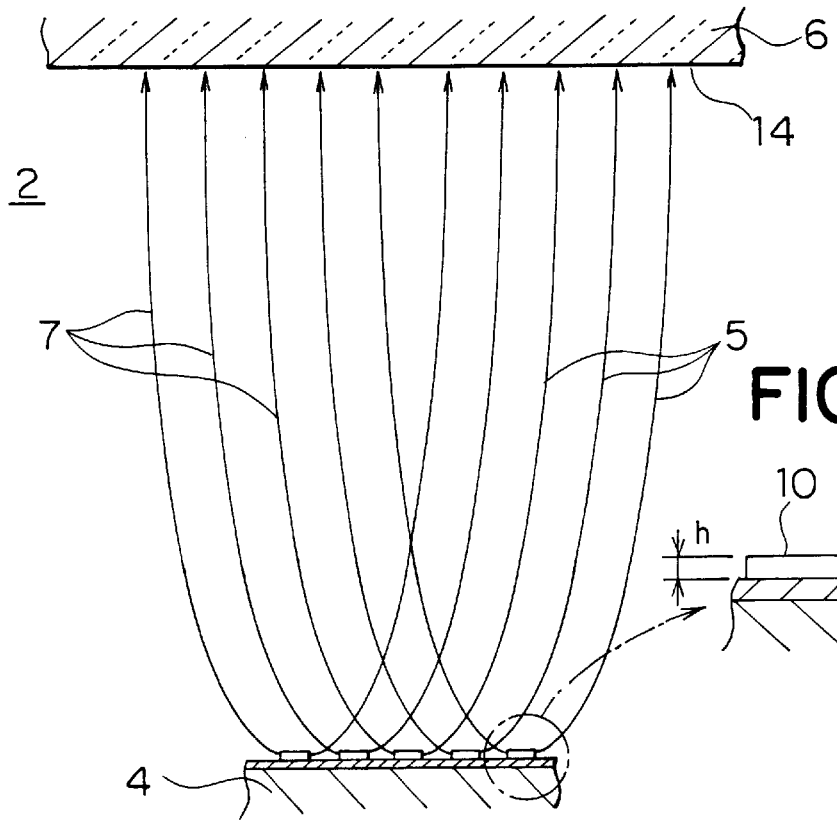

The flat display apparatus according to the present invention will be explained in further detail below with reference to the preferred embodiments shown in the drawings.

Figure 1B:
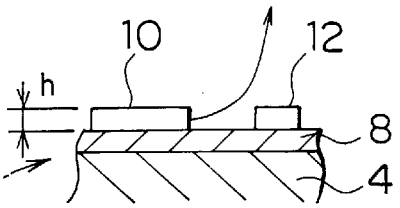

The flat display apparatus 2 according to the first embodiment shown in FIGS. 1A and 1B has a drive substrate 4 and a counter substrate 6. The drive substrate 4 is, for example, comprised of a monocrystalline silicon wafer on the surface of which is formed an insulating film 8. The insulating film 8 is comprised of a silicon oxide film etc. and is formed on the surface of the silicon drive substrate 4 by heat oxidation or the CVD method. The thickness of the insulating film 8 is not particularly limited, but for example is a thickness of 10 to $10^3$ nm.

Figure 2:
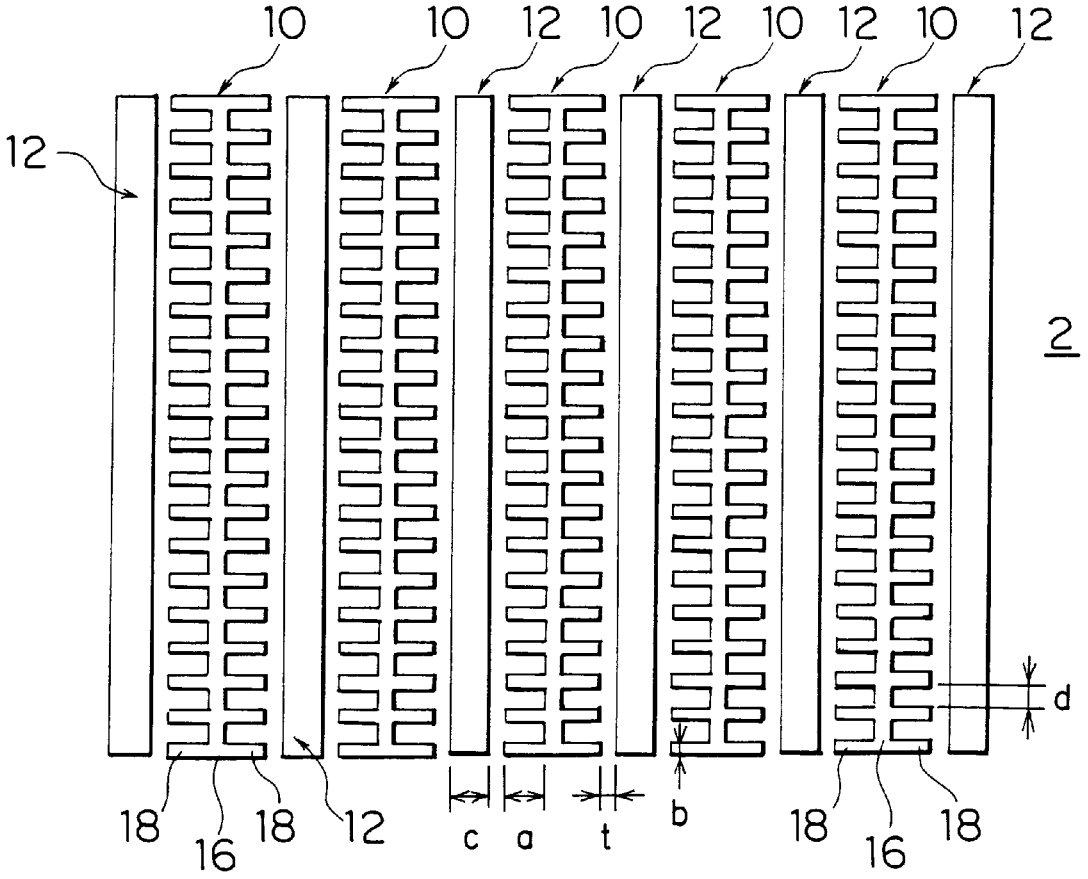
FIG. 2 is a plane view of a pattern of emitter electrodes and gate electrodes formed on the surface of a drive substrate according to a second embodiment of the present invention.

In the present embodiment, the emitter electrodes 10 and the gate electrodes 12 are formed in the pattern shown in FIG. 2 on the insulating film 8 by etching the same layer. The emitter electrodes 10 and the gate electrodes 12 are comprised, for example, of molybdenum (Mo), tungsten silicide (W—Si), or molybdenum silicide (Mo—Si) and are formed on the insulating film 8 by electron beam vapor deposition, sputtering, etc.

In this embodiment, the gate electrodes 12 are formed linearly so as to extend in the columnar direction substantially parallel at predetermined intervals as shown in FIG. 2. The emitter electrodes 10 are disposed between these gate electrodes 12 and each have a root electrode 16 substantially parallel to the gate electrodes 12 and emitter branch electrodes 18 branching from the root electrode 15 to the two sides.

The length of projection a of the emitter branch electrodes 18 is not particularly limited, but is preferably 0.1 to 5 μm. The width b of the emitter branch electrodes 18 is preferably 0.1 to 1 μm. The width c of the gate electrodes 12 is preferably 0.1 to 1 μm. Further, the width b of the emitter branch electrodes 18 functioning as the emitter electrodes is substantially the same at the front ends and the root ends. The distance t between the front ends of the emitter branch electrodes 18 functioning as the emitter electrodes and the gate electrodes 12 is determined, in relation with the thickness h of the emitter electrodes 10 (see FIGS. 1A and 1B), so that the electric-field intensity becomes at least 0.1 V/Å. More specifically, 1±0.5 μm is preferred. Further, the thickness h of the emitter electrodes 10 is determined in the same way as the thickness of the gate electrodes 12 so that the field intensity becomes at least 0.1 V/Å. More specifically, h is not more than 100 Å. With a field intensity of less than 0.1 V/Å, the emission of electrons is not stable and use of the device as a flat display apparatus is difficult.

The distance d in the columnar direction between the emitter branch electrodes 18, 18 of the emitter electrodes 10 is determined so that the fields of the emitter branch electrodes 18, 18 do not influence each other and, for example, is made 0.5 to 5 μm.

The gate electrodes 12 and emitter electrodes 10 of the pattern shown in FIG. 2 can be easily formed by etching the same layer by the photolithographic method using a single mask. The production process is extremely easy.

As shown in FIG. 1A, in this embodiment, the counter substrate 6 is arranged at a predetermined distance from the drive substrate 4. The counter substrate 6 is comprised for example of a transparent plate made of glass etc. On the surface at the drive plate side is formed a fluorescent screen 14 which fluoresces when irradiated by an electron beam. An anode voltage is supplied to the fluorescent screen 14.

The distance between the drive substrate 4 and the counter substrate 6 is not particularly limited, but, for example, is 300 μm or so. It is preferable that a vacuum of $10^{-3}$ to $10^{-4}$ Torr be established in the space between the drive substrate 4 and the counter substrate 6. This is to stabilize the emission of electrons.

Figure 5:
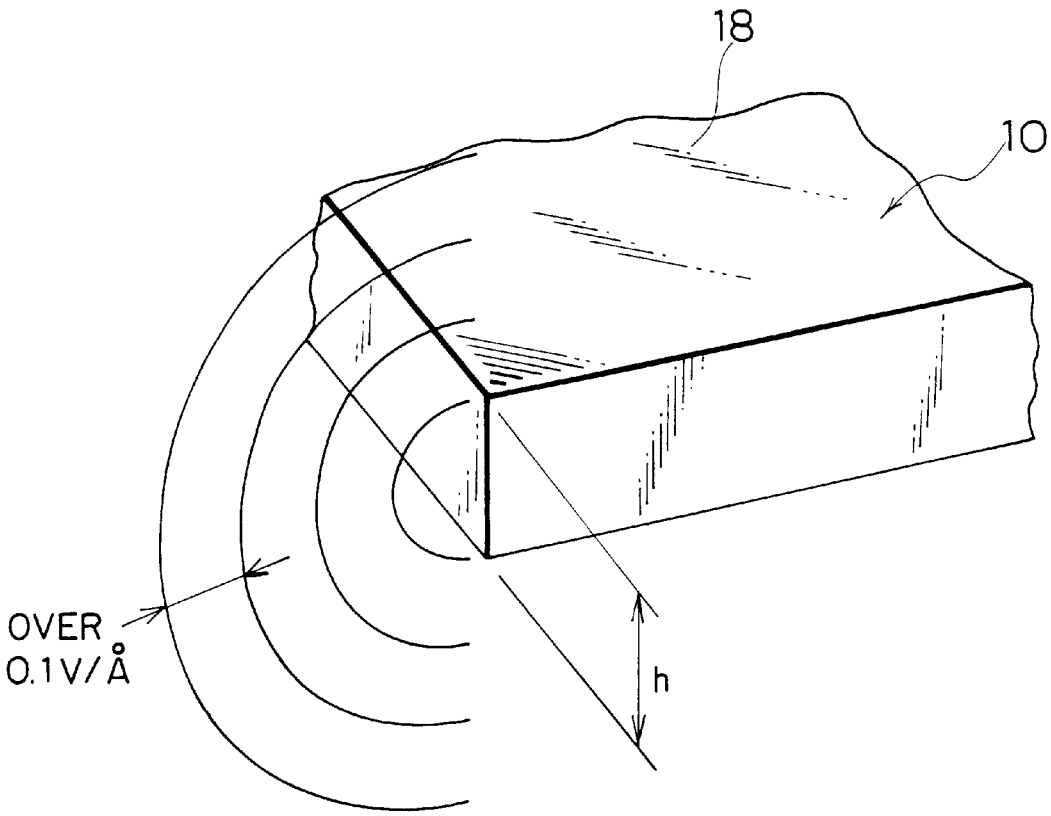
FIG. 5 is an explanatory view of the field intensity at the front end of an emitter electrode.

In the flat display apparatus 2 according to this embodiment, by applying a negative voltage of about −50V to the emitter electrodes 10, applying 0V to the gate electrodes 12, and applying a voltage of ±2 kV to the anode electrodes of the fluorescent screen 14, a strong electric-field is created at the front ends of the emitter branch electrodes 18 of the emitter electrodes 10. In this embodiment, the field intensity occurring at the front ends of the emitter branch electrodes 18 of the emitter electrodes 10 is shown in FIG. 5. As shown in FIG. 5, in this embodiment, the field intensity occurring at the front ends of the emitter branch electrodes 18 was confirmed to be at least 0.1 V/Å.

Therefore, electrons were emitted from the front ends of the emitter branch electrodes 18 toward the gate electrodes 12. While heading toward the gate electrodes 12, the path of progression of the electrons is bent to turn toward the higher potential anode electrodes (fluorescent screen 14) side to give the path shown by the numerals 5 and 7 in FIG. 1A. The electrons strike the fluorescent screen 14 which then gives out light.

Note that it is possible to select the column of the emitter electrode 10 from which electrons are to be emitted by applying a negative voltage to only the specific column of the emitter electrode 10. Further, it is possible to select the row of the emitter electrode from which electrons are to be emitted by controlling another layer of electrodes, not shown.

In the flat display apparatus 2 according to this embodiment, by forming the emitter electrodes 10 and the gate electrodes 12 in the same layer, it is possible to simplify the production process in comparison with the production process of a flat display apparatus having microcathodes (emitter electrodes) with tapered front ends of the conventional structure.

By forming the emitter electrodes 10 so that they become uniform in thickness, it is possible to suppress fluctuations in the extraction voltage from the emitter electrodes 10. That is, by controlling the thickness of the emitter electrodes 10 to the thickness necessary for field emission (not more than several hundred angstroms) and suppressing the variation in thickness to within a predetermined range (±5%), it is possible to realize uniformity of the extraction voltage and a longer lifetime of the emitter electrodes.

Further, it is possible to adjust the extraction voltage of the emitter electrodes 10 by controlling the thickness of the emitter electrodes 10. By adjusting the voltage by controlling the thickness of the emitter electrodes 10, it is possible to set the extraction voltage lower assuming the same field intensity as in the past.

Further, by making the width of the front ends of the emitter branch electrodes 18 of the emitter electrodes 10 substantially equal to the width of the root ends, the path of the electrons emitted from the front ends of the emitter branch electrodes 18 and heading toward the gate electrodes 12 becomes constant and there is less chance of pixel defects.

Next, another embodiment of the present invention will be explained.

Figure 3:
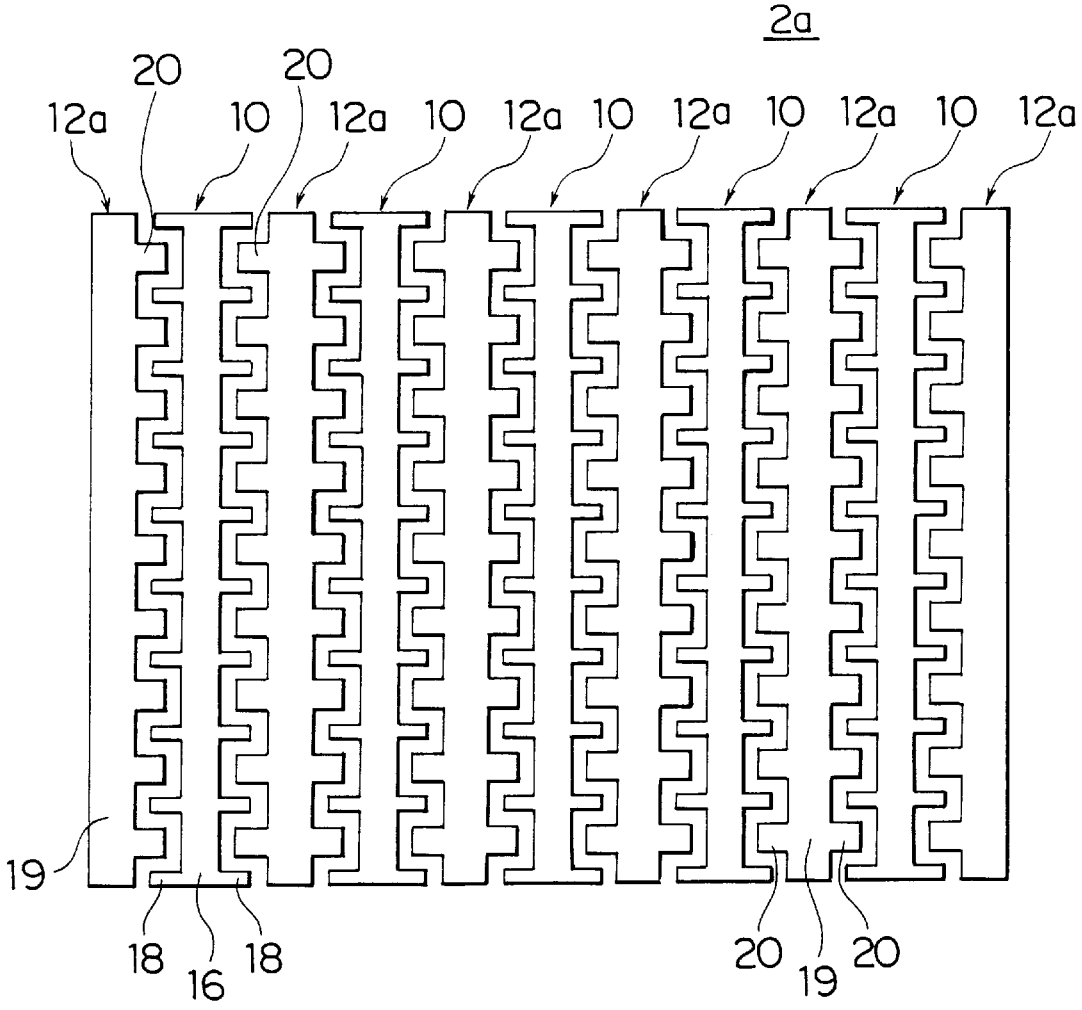
FIG. 3 is a plane view of a pattern of emitter electrodes and gate electrodes according to a third embodiment of the present invention.

In the flat display apparatus 2*a* according to the embodiment shown in FIG. 3, the gate electrodes 12*a* are each comprised of the gate root electrode 19 and the gate branch electrodes 20 branching from the root electrode 19 to the two sides. The gate branch electrodes 20 are disposed to be positioned between two adjoining emitter branch electrodes 18 of the emitter electrodes 10.

In this embodiment, since the gate branch electrodes 20 are arranged between adjoining emitter branch electrodes 18, it is possible to effectively prevent the fields of the front ends of the adjoining emitter branch electrodes 18 from influencing each other. Further, in this embodiment, not only the electrons heading from the front ends of the emitter branch electrodes 18 to the root electrodes 19 of the gate electrodes 12, but also electrons heading from the front ends of the emitter branch electrodes 18 to the gate branch electrodes 20 are finally irradiated on the fluorescent screen 14 shown in FIG. 1A, so an improvement in the brightness can be expected.

Other configurations and actions of the second embodiment shown in FIG. 3 are similar to those of the embodiments shown in FIGS. 1A and 1B and FIG. 2, so explanations of them will be omitted.

Figure 4:
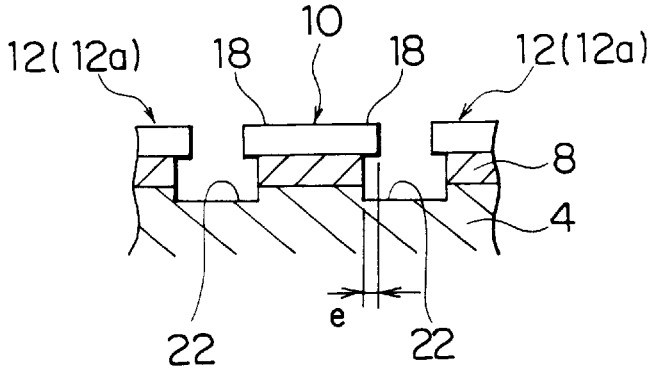
FIG. 4 is a cross-sectional view of key portions of a drive substrate used for a flat display apparatus according to a fourth embodiment of the present invention.

FIG. 4 is a view of a third embodiment of the present invention.

In the embodiment shown in FIG. 4, trenches 22 are formed by self-alignment at positions between the emitter electrodes 10 and the gate electrodes 12 or 12*a* in the surface of the drive substrate 4 on which the electrodes 10, 12 (or 12*a*) are formed. These trenches 22 are formed so that the front ends of the emitter branch electrodes 18 of the emitter electrodes 10 project out from the trenches 22 at a distance of an overhang e. The overhang e is not particularly limited, but is preferably 100 to 5000 Å.

By forming the trenches 22 in this way, it is possible to obtain an enough distance between the side face of the emitter electrode 10 and the facing side face of the gate electrode 12 so as to enable flexibility for raising the operating potential between the emitter electrodes 10 and the gate electrodes 12. That is, in the process of production of the flat display apparatus, by applying 0V to the gate electrodes 12 (12*a*) and a reverse bias of about ±1 kV to all of the emitter electrodes 10, it is possible to cause an evaporation phenomenon by the electric-field to occur from the front ends of the emitter branch electrodes 18, remove the microscopic projections of the front ends, and ensure a uniform shape of the front ends of the emitter branch electrodes 18.

Note that the present invention is not limited to the above embodiments and includes various modifications within the scope of the claims.

As explained above, according to the flat display apparatus of the present invention, by forming the emitter electrodes and the gate electrodes in the same layer, it is possible to simplify the production process compared with the production process of a flat display apparatus having microcathodes (emitter electrodes) with tapered front ends as in the conventional structure.

By forming the emitter electrodes so that they become uniform in thickness, it is possible to suppress fluctuations in the extraction voltage from the emitter electrodes.

Further, it is possible to adjust the extraction voltage of the emitter electrodes by controlling the thickness of the emitter electrodes. By adjusting the voltage through control of the thickness of the emitter electrodes, it is possible to set the extraction voltage lower assuming the same field intensity as in the past.

Further, by making the width of the front ends of the emitter electrodes on the gate electrode side substantially equal to the width of the root ends, the path of the electrons emitted from the emitter electrodes and heading toward the gate electrodes becomes constant and there is less chance of pixel defects.

What is claimed is:

1. A flat display apparatus comprising:

an emitter electrode provided at a position facing a fluorescent screen, and emitting electrons; and a gate electrode for controlling the electrons emitted from said emitter electrode, said electron emitting electrode and said gate electrode being formed on the same plane and formed from a single layer of conductive material.

2. A flat display apparatus as set forth in claim 1, further comprising:

a drive substrate on which said emitter electrode and gate electrode are formed;

wherein said fluorescent screen is positioned a predetermined distance away from and in a substantially parallel direction to said emitter electrode and said gate electrode.

3. A flat display apparatus as set forth in claim 2, wherein said emitter electrode comprises a root emitter electrode substantially parallel to said gate electrode and a plurality of branch emitter electrodes extending from said root emitter electrode, wherein an end of each of said branch emitter electrodes faces said gate electrode and a width of each of said branch emitter electrodes remains substantially the same along a length thereof.

4. A flat display apparatus as set forth in claim 1, wherein a distance between said emitter electrode and gate electrode and a thickness of said emitter electrode are determined so that an electric-field intensity between said emitter electrode and said gate electrode becomes at least 0.1 V/Å.

5. A flat display apparatus as set forth in claim 1, wherein the thickness of said emitter electrode is made uniform within ±5% and is not more than 100 Å.

6. A flat display apparatus as set forth in claim 1, wherein said emitter electrode and said gate electrode and formed on a drive substrate which incorporates a trench formed in the surface of said drive substrate at a position between said emitter electrode and said gate electrode.

7. A flat display apparatus as set forth in claim 1, wherein said emitter electrode is comprised of an emitter root electrode and a plurality of emitter branch electrodes extending from said emitter root electrode.

8. A flat display apparatus as set forth in claim 7, wherein said gate electrode is comprised of a gate root electrode and a plurality of gate branch electrodes branching from said gate root electrode and each of said gate branch electrodes is positioned between adjacent emitter branch electrodes.

9. A flat display apparatus comprising:

an emitter electrode for emitting electrons comprising a root emitter electrode and a plurality of branch emitter electrodes extending from either side of said root emitter electrode;

a gate electrode for controlling the emission of electrons from said emitter electrode comprising a root gate electrode extending substantially parallel to said root emitter electrode and a plurality of branch gate electrodes extending from either side of said root gate electrode, such that each branch gate electrode extends into a space between two adjacent branch emitter electrodes;

a drive substrate on which said emitter electrode and said gate electrode are formed; and a screen substrate having a fluorescent screen which is positioned a predetermined distance away from and substantially parallel to the drive substrate.

10. A flat display apparatus as set forth in claim 9, wherein a width of each of said branch emitter electrodes remains constant along a length thereof.

11. A flat display apparatus as set forth in claim 9, wherein the distance between said emitter electrode and said gate electrode and the thickness of said emitter electrode are determined so that the electric-field intensity between said emitter electrode and said gate electrode becomes at least 0.1 V/Å.

12. A flat display apparatus as set forth in claim 11, wherein the thickness of said emitter electrodes is not more than 100 Å.

13. A flat display apparatus as set forth in claim 9, further comprising a plurality of emitter electrodes and a plurality of gate electrodes alternately interspersed with each other on said drive substrate, wherein trenches are formed in the surface of said drive substrate at positions between said emitter electrodes and said gate electrodes.

14. A flat display apparatus as set forth in claim 9, wherein said emitter electrode and said gate electrode are formed from a single conductive layer.

15. A flat display apparatus as set forth in claim 14, wherein said conductive layer is made of molybdenum, molybdenum silicide or tungsten silicide.

16. A flat display apparatus as set forth in claim 2, wherein a vacuum exists between said drive substrate and said fluorescent screen.

17. A flat display apparatus as set forth in claim 1, further comprising at least one anode electrode disposed on said fluorescent screen.

18. A flat display apparatus as set forth in claim 17, wherein a voltage of −50 V is applied to said emitter electrode, a voltage of 0 V is applied to said gate electrode, and a voltage of 2 kV is applied to said at least one anode electrode.

19. A flat display apparatus as set forth in claim 6, wherein a part of said gate electrode projects over said trench a distance of about 100 to 5000 Å.

20. A flat display apparatus comprising:

an emitter electrode provided at a position facing a fluorescent screen, and emitting electrons; and a gate electrode for controlling the electrons emitted from said emitter electrode, wherein the thickness of said emitter electrode is made uniform within ±5% and is not more than 100 Å.

* * * * *